US006905140B2

(12) United States Patent
Polick

(10) Patent No.: US 6,905,140 B2
(45) **Date of Patent: *Jun. 14, 2005**

(54) COMBINATION INTERACTIVE BOOK AND LOCKABLE STORAGE DEVICE

(75) Inventor: Peter Polick, New York, NY (US)

(73) Assignee: Innovative USA, Inc., Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/827,985

(22) Filed: Apr. 19, 2004

(65) Prior Publication Data

US 2004/0195820 A1 Oct. 7, 2004

Related U.S. Application Data

(63) Continuation of application No. 09/993,356, filed on Nov. 5, 2001, now Pat. No. 6,779,814.

(51) Int. Cl.[7] ..... B42D 5/00

(52) U.S. Cl. ..... 281/15.1; 70/3; 70/80; 206/472; 206/745; 220/524; 281/19.1; 281/51; 434/317

(58) Field of Search ..... 281/15.1, 19.1, 281/22, 36–38, 51; 206/38, 472, 745, 747; 434/317; 220/524; 70/3–5, 80

(56) References Cited

U.S. PATENT DOCUMENTS

| | | | | | |
|---|---|---|---|---|---|
| 2,072,076 | A | * | 3/1937 | Awiszus | 70/312 |
| 2,271,204 | A | * | 1/1942 | Peters | 70/58 |
| 3,983,724 | A | * | 10/1976 | Foote | 70/25 |
| 4,453,743 | A | * | 6/1984 | Sanders et al. | 281/18 |
| 4,817,769 | A | * | 4/1989 | Saliba | 190/18 R |
| 4,875,707 | A | * | 10/1989 | Krom | 281/30 |
| 5,213,507 | A | * | 5/1993 | Ozrovitz | 434/178 |
| 5,325,792 | A | * | 7/1994 | Mulloy | 108/28 |
| 5,466,158 | A | * | 11/1995 | Smith, III | 434/317 |
| 5,553,712 | A | * | 9/1996 | Tisbo et al. | 206/752 |
| 5,567,163 | A | * | 10/1996 | Ku | 434/317 |
| 5,769,217 | A | * | 6/1998 | Derraugh et al. | 206/308.1 |
| 5,916,280 | A | * | 6/1999 | Lantz | 70/68 |
| 5,947,271 | A | * | 9/1999 | Follman | 206/19 |
| 6,105,763 | A | * | 8/2000 | Saetia | 206/320 |
| 6,494,759 | B1 | * | 12/2002 | Polick | 446/148 |
| 6,684,667 | B2 | | 2/2004 | Young | |
| 6,779,814 | B2 | * | 8/2004 | Polick | 281/15.1 |
| 2003/0025316 | A1 | * | 2/2003 | Solomon et al. | 281/15.1 |
| 2003/0029207 | A1 | * | 2/2003 | Young | 70/18 |
| 2003/0085563 | A1 | * | 5/2003 | Polick | 281/15.1 |

* cited by examiner

*Primary Examiner*—Monica S. Carter
(74) *Attorney, Agent, or Firm*—Hedman & Costigan, P.C.

(57) ABSTRACT

A combination book and storage device comprising a container with at least one cover which contains locking mechanism which is simple to operate and manufacture and a book which is mounted so that when the cover of the storage device is locked the book is still accessible.

6 Claims, 13 Drawing Sheets

COMBINATION INTERACTIVE BOOK AND LOCKABLE STORAGE DEVICE

This is a continuation of application Ser. No. 09/993,356, filed on Nov. 5, 2001 now U.S. Pat. No. 6,779,814.

FIELD OF THE INVENTION

The present invention relates to a combination interactive book and storage device having one or more lockable compartments and a book. The present invention further relates to a combination interactive book and storage device where the book functions as an instruction manual for a game or a day and time planner, diary or address book or any combination thereof requiring a lockable storage compartment and a reference book of information.

BACKGROUND OF THE INVENTION

The book market includes books written specifically for particular groups. In addition, the market includes books that are specifically designed in size and shape to capture the attention of the reader and/or help illustrate the material presented. This is especially the case in the context of books written for children.

The contents of diaries, books or other journals are available with means that provides security from intrusion and unwanted inspection by the use of locking devices. These locking devices have been incorporated into book enclosures in a variety of ways.

The most relevant prior art includes bound volumes that contain a combination lock to secure the front and back covers together, thereby preventing access to the contents of the pages. Sanders, U.S. Pat. No. 4,453,743 describes a diary-like book with a traditional style rotary two-stage combination lock. The combination lock is preset and the combination cannot be reset by the consumer. It is mounted on a latch member that secures the front and rear covers together. Peters et al., U.S. Pat. No. 2,271,204 discloses a diary-like book on which is mounted a lock that consists of three pointers positioned about a semi-circular dial. This non-programmable lock is mounted on the front cover and engages a latch suitably attached to a strap which secures the front and rear covers.

None of the prior art references disclose a device comprising a lockable compartment and an interactive book wherein the lock is programmable, easy to manufacture and simple to incorporate into a storage device and wherein the book is accessible even when the compartment is locked. Further, the prior art teaches the inclusion of the lock for protection of the information contained within the pages of the book, therefore necessitating the placement of the lock in such a manner that even when the lock is not engaged the book is difficult to read.

SUMMARY OF THE INVENTION

The present inventor has developed a storage device comprising a container with at least one cover that contains a locking mechanism that is simple to operate and manufacture and a book that is attached to the storage device in a manner such that when the cover of the storage device is locked the book is still accessible. Thus, the invention serves as a conduit for information that is not confidential and a secure repository for confidential information and/or elements that may be stored in the compartment.

It is therefore an object of the present invention to provide a combination book and storage device with a programmable lock mechanism that is simple to manufacture and can be used to lock a container that also has an accessible book mounted on the combination book and storage device.

It is further an object of the present invention to provide a combination book and container having a book mounted to the cover of the container.

It is a still further object to provide a programmable combination type lock which may be operated by children and adults and alike.

It is another object of the present invention that the accessible book provides materials in the form of games and/or puzzles or the like that provide clues to discerning the combination to open the locked portion of the storage device.

These and other objects will become evident to those skilled in the art from the appended specification.

DETAILED DESCRIPTION OF THE INVENTION

Figure 1A:
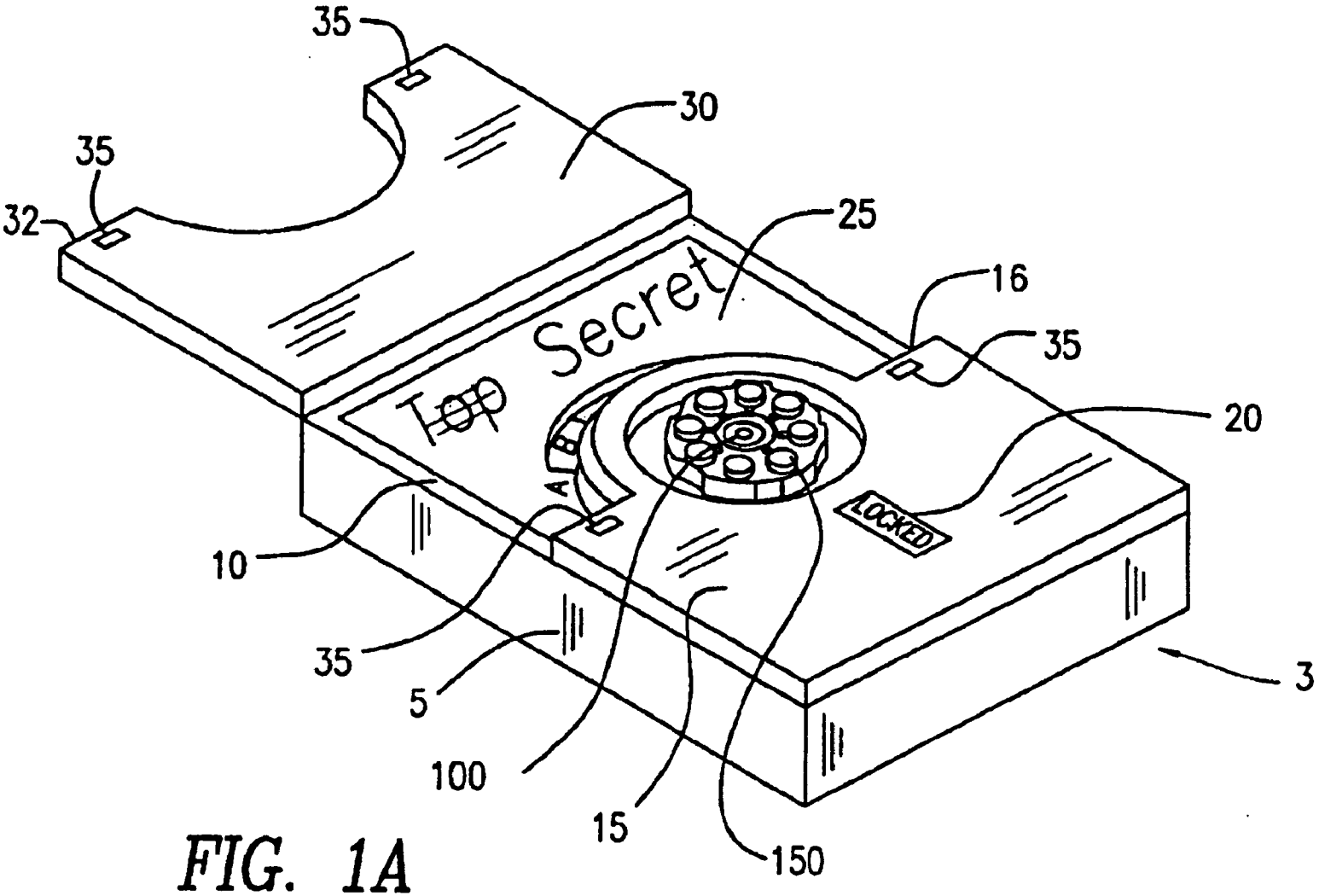
FIG. 1A is a top perspective view of an embodiment of the present invention with a book covering lid in the open position and the storage compartment lid in the closed locked position in accordance with the present invention.

Referring to FIG. 1A, there is shown a top-side view of a combination book and lockable storage device of the present invention 3 which comprises a container 5 with a hingably attached primary cover 15 in the closed locked position and a hingably attached secondary cover 10 in the closed position and containing a locking mechanism 100 with exterior sliders 150 and a display 20 for the designation of the status of the locking mechanism 100. When secondary cover 10 is closed first and then primary cover 15 is closed second, it is possible to secure both covers with the locking mechanism 100 by provision of a lip (not shown) on the left edge of primary cover 15 to overlap the right side edge of secondary cover 10. Attached to the top of secondary cover 10 is a book 25 with a lid 30 in the open position. When closed, the lid 30 may be secured to the cover 15 with magnets 35, VELCRO® hook and loop fasteners, snaps or other means known to those skilled in the art.

Figure 1B:
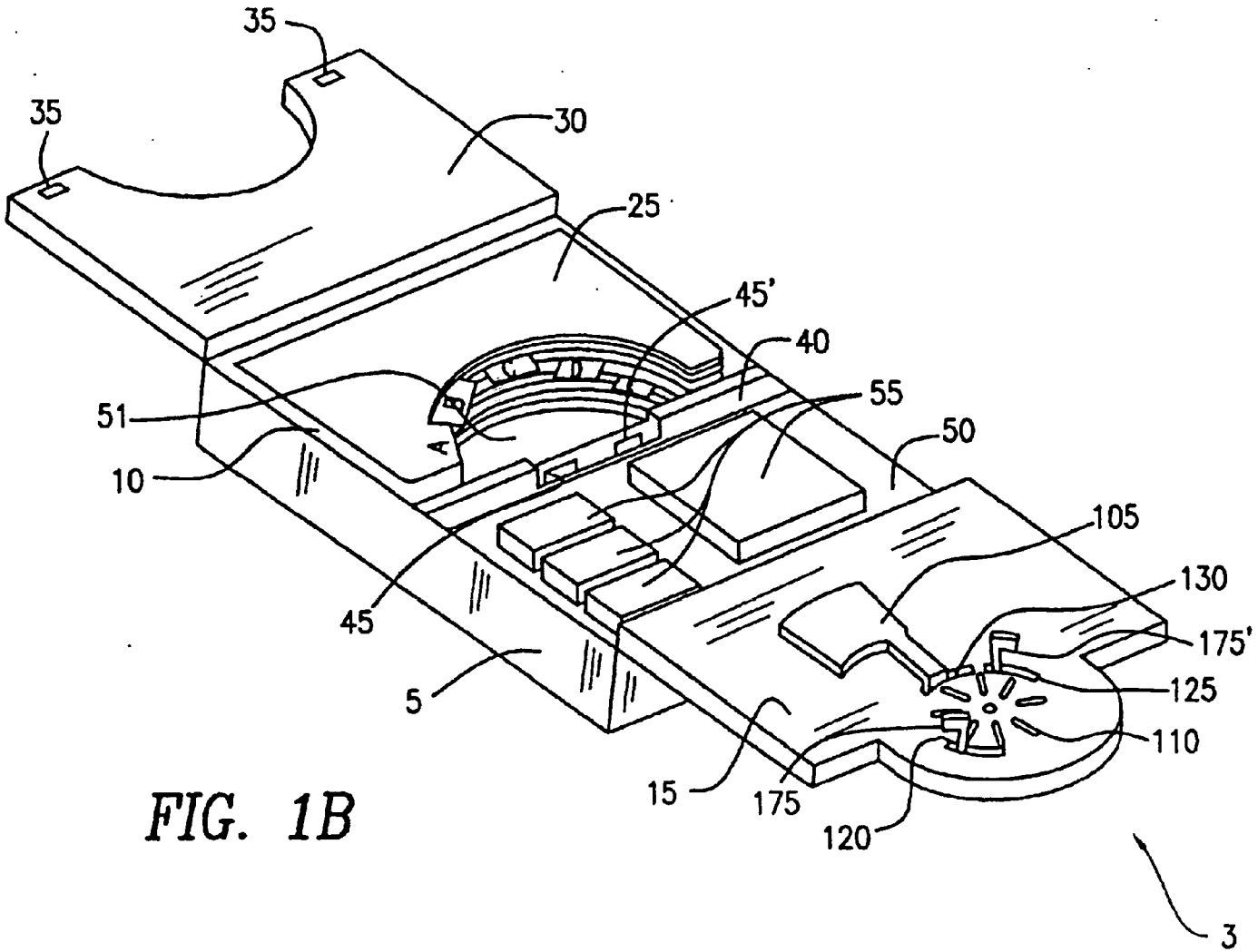
FIG. 1B is a top perspective view of an embodiment of the present invention with a book covering lid in the open position and a container covering lid in the open unlocked position in accordance with the present invention.

Referring to FIG. 1B, there is shown a top-side view of a combination book and lockable storage device 3 of the present invention which comprises a container 5 with a hingably attached secondary cover 10 in the closed position and a hingably attached primary cover 15 in the open position, exposing a lockable storage area 50. The lockable storage area contains at least one wall 40 which contains two die cut or molded holes 45 and 45' suitable for accepting hook shaped protrusions 175 and 175', respectively, of the locking mechanism 100. The cover 15 containing a locking mechanism 100 (see FIG. 1A) has between two and twenty die cut or molded slots 110, with the preferred number of slots being from six to eight, formed in a circular pattern to accommodate the sliders 150 (see FIG. 1A) of the locking mechanism 100. See also FIGS. 5A–5D discussed below. The lockable storage areas 50 and 51 may contain educational and/or game related manipulatives 55.

The cover 15 containing the locking mechanism 100 is constructed of any suitable rigid material and a die cut or molded window 20 (FIG. 1A) to display a position of a locking mechanism indicator panel 105.

The primary cover 15 containing the locking mechanism 100 has two die cut or molded concave slots 120 and 125 around the perimeter of the slots 110 for the sliders 150. Slots 120 and 125 provide arc-shaped grooves for guiding the rotary sliding movement of the hook shaped protrusions 175 and 175' of the locking mechanism 100 into holes 45 and 45', respectively.

The primary cover 15 containing the locking mechanism 100 also has a die cut or molded concave slot 130 between the window 20 (FIG. 1A) and the perimeter of the slots 110. The slot 130 allows for and guides the rotary sliding movement for the attachment of the indicator panel 105 to the locking mechanism 100 at the molded connection 106 (see FIG. 5B). The indicator panel 105 is provided with the written indications "LOCKED" and "UNLOCKED" or the like (see FIG. 1A), and the indicator panel 105 is synchronized with the locking mechanism 100 such that when the locking mechanism 100 is in its locked position, the position of the indicator panel 105 that reads "LOCKED" moves to be aligned with the window 20. In like fashion, when the locking mechanism 100 is in its unlocked position, the position of the indicator panel 105 that reads "UNLOCKED" moves to be aligned with the window 20. The primary cover 15 has between two and twenty die cut or molded slots 110, with the preferred number of slots being eight, formed in a circular pattern to accommodate the sliders 150 (FIG. 1A) of the locking mechanism 100. Alternatively, a linear locking mechanism may be employed in the practice of the present invention as will be appreciated by those skilled in the art in light of the description herein.

Figure 2:
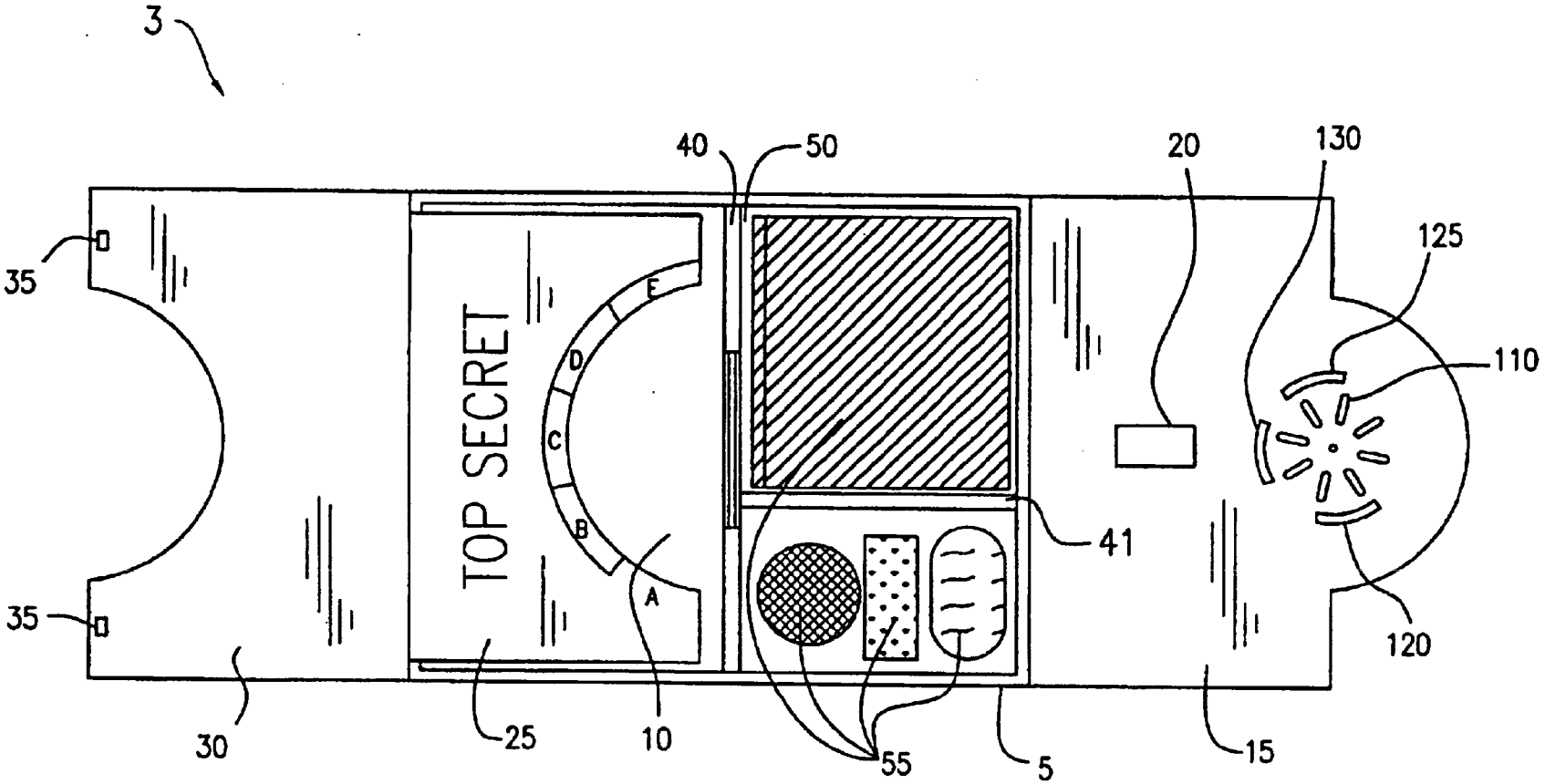
FIG. 2 is a top plan view of an embodiment of the present invention with a book covering lid in the open position and a container covering lid in the open position in accordance with the present invention.

Referring to FIG. 2, there is shown a top plan view of a combination book and lockable storage device 3 of the present invention which comprises a container 5 with a hingeably attached secondary cover 10 in the closed position and a hingeably attached primary cover 15 in the open position, exposing the lockable storage area 50 bound on the left side by wall 40. Inside storage area 50 there can be seen manipulatives 55. Wall 41 partitions storage area 50 into two separate compartments. Of course, additional partition walls can be added to provide further compartmentalization. The cover or lid 30 of the accessible book 25 is in the open position. The primary cover 15 containing the locking mechanism 100 (FIG. 1A) has between two and twenty die cut or molded slots 110, with the preferred number of slots being eight, formed in a circular pattern around the die cut or molded axis to accommodate the sliders 150 (FIG. 1A) of the locking mechanism 100 (FIG. 1A).

Figure 3A:
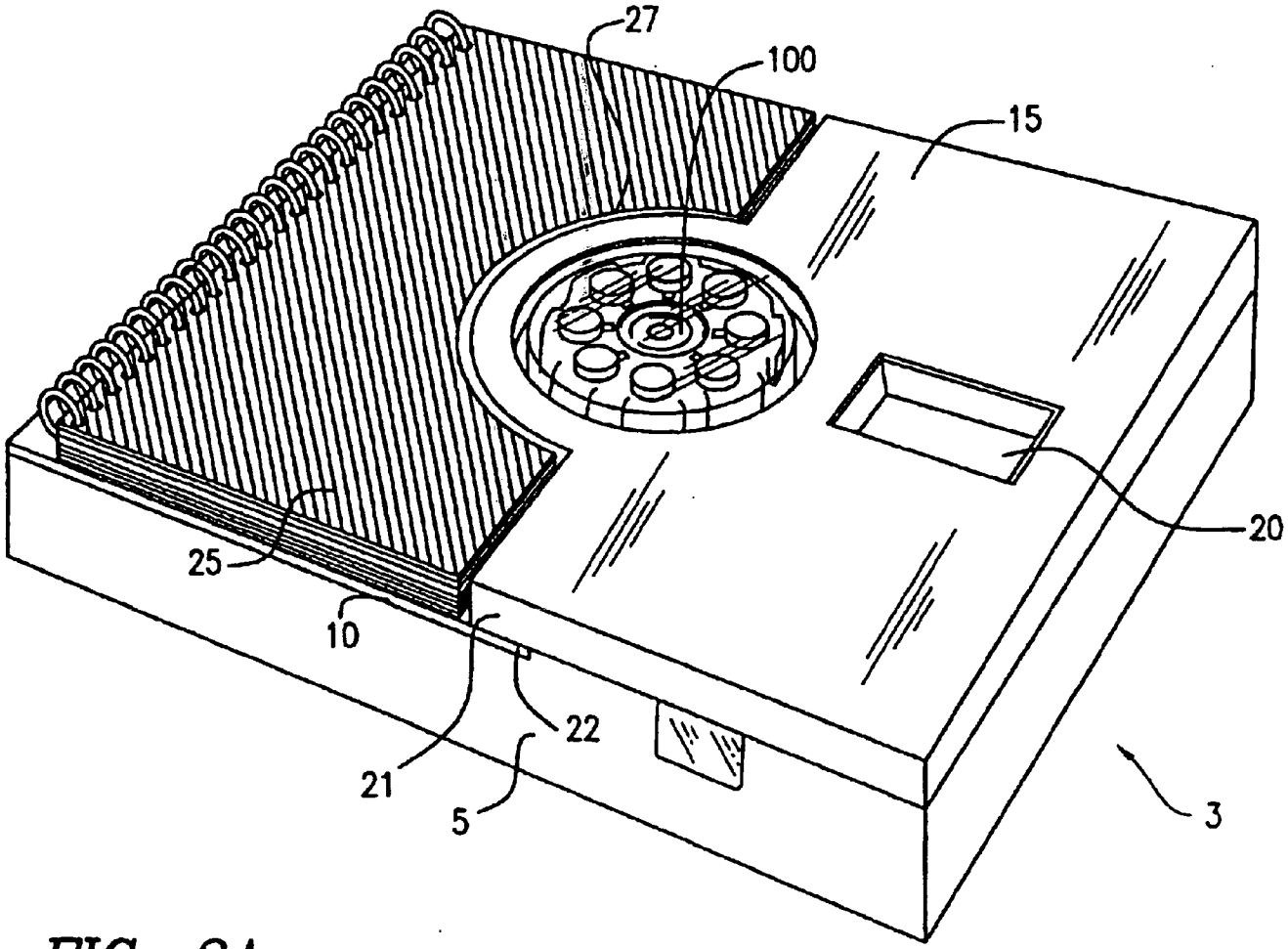
FIG. 3A is a perspective view of an embodiment of the present invention with both the primary and secondary covers closed and a book mounted on the top of the secondary cover.

Referring to FIG. 3A, there is shown another embodiment of a combination book and storage device 3 of the present invention comprising a container 5 with the primary cover 15 and the secondary cover 10 in the closed position and secured with a rotary locking mechanism 100. Book 25 is provided with a concave cut out portion 27 to accommodate the rotary locking mechanism 100. The primary cover 15 has a die cut or molded window 20 to allow viewing of the locking mechanism indicator panel (not shown). A book 25 is mounted to the top of the secondary cover 10 either permanently such as by adhering the back cover of book 25 to the top of secondary cover 10, or by detachable means, such as by including VELCRO® hook and loop fasteners, magnets or snaps between the back cover of book 25 and the top of secondary cover 10. The back cover of book 25 could also slide into a pocket formed on the top of secondary cover 10. As can readily be seen in FIG. 3A, the book 25 is accessible to the user even though the primary cover is in the locked position. Additionally as can be seen in FIG. 3A, the left edge 21 of primary cover 15 overlaps the right edge 22 of secondary cover 10, thus locking down secondary cover 10 when primary cover 15 is locked. In this embodiment, with both covers 10 and 15 to container 5 locked, the book 25 still remains accessible to the user.

Figure 3B:
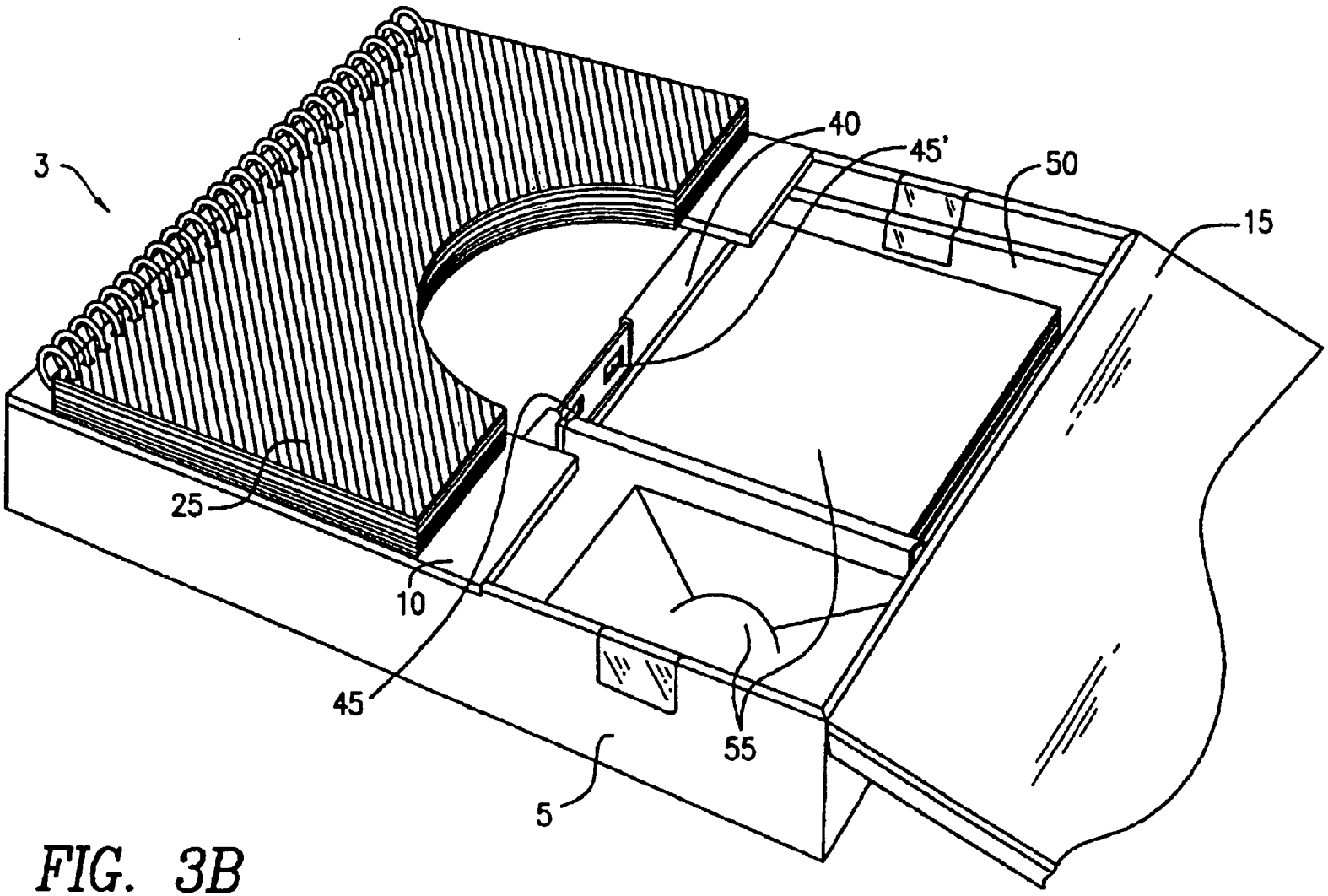
FIG. 3B is a perspective view of an embodiment of the present invention with the primary cover open, revealing the storage compartment, and the secondary cover closed with a book mounted on the top of the secondary cover.

Referring to FIG. 3B, there is shown a combination book and storage device 3 of the present invention with the primary cover 15 open, revealing the first storage compartment 50 for containing manipulatives 55 in container 5, including a partition 40 which is die cut or molded to provide two holes 45 and 45' suitable for accepting the hook shaped locking protrusions 175 and 175' (not shown), respectively, and the secondary cover 10 closed to cover a second storage compartment (not shown) with a book 25 mounted to the top of secondary cover 10.

Figure 3C:
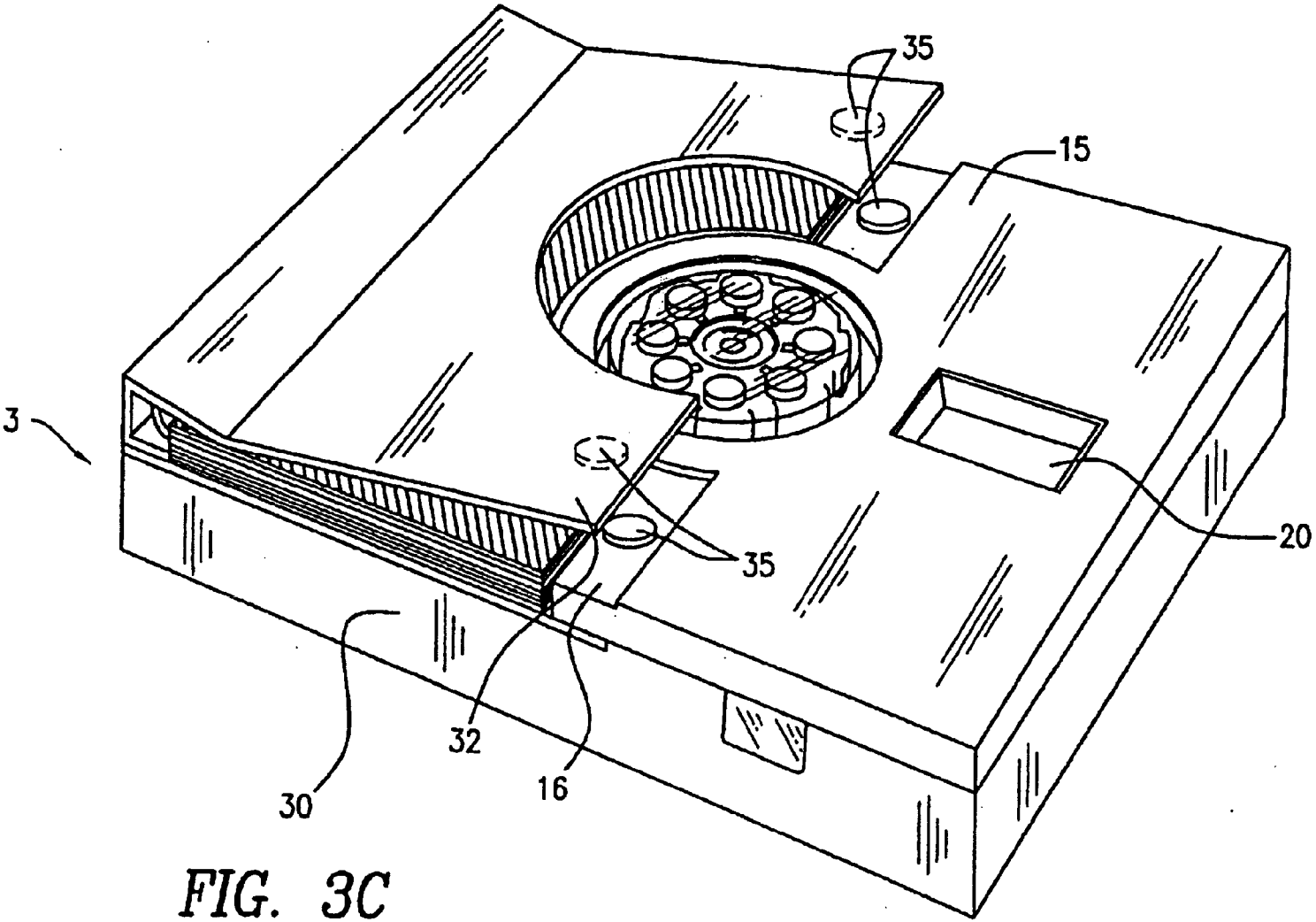
FIG. 3C is a perspective view of an embodiment of the invention with the storage compartment cover in the closed locked position and the optional lid covering the book partially open and detailing a method of securing the optional lid to the primary cover, such as, for example, the placement of magnetic pieces at the interior edge of both the optional lid and the primary cover.

Referring to FIG. 3C, there is shown a combination book and storage device 3 with the book lid 30 partially open that illustrates the preferred placement of the materials that will secure the optional book lid 30 to the primary cover 15 namely, the placement of magnets, VELCRO® hook and loop fasteners, snaps or other suitable securing means 35 known in the art, at the interior edge 32 of the interior side of the lid 30 and the left edge 16 of the exterior side of the primary cover 15. In this manner, the lid 30 is prevented from opening during transport of the device 3, but can still be opened without unlocking the box.

Figure 4:
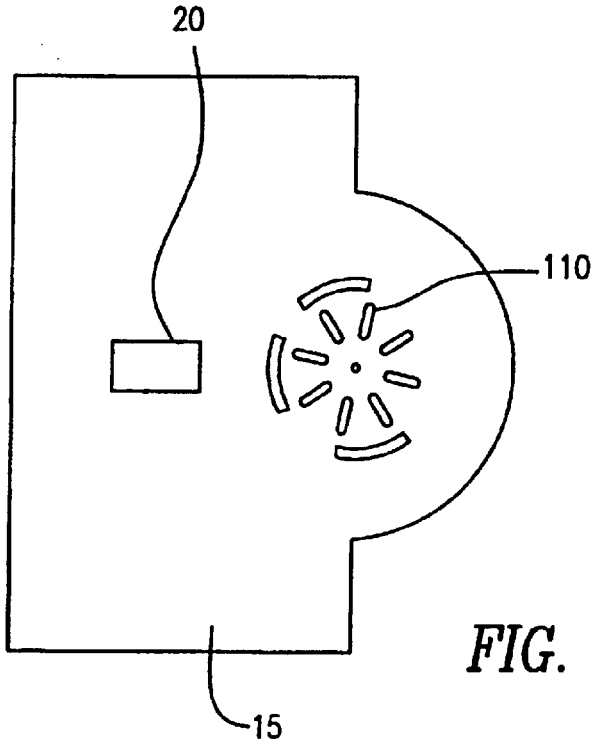
FIG. 4 is a back plan view of the primary cover of the storage device of FIG. 1 in accordance with the present invention.

Referring to FIG. 4, there is shown the interior side of the primary cover 15 of a storage device of the present invention in opened position with eight die cut or molded slots 110 formed in a circular pattern to accommodate interior sliders (not shown) of the locking mechanism (not shown).

Figure 4A:
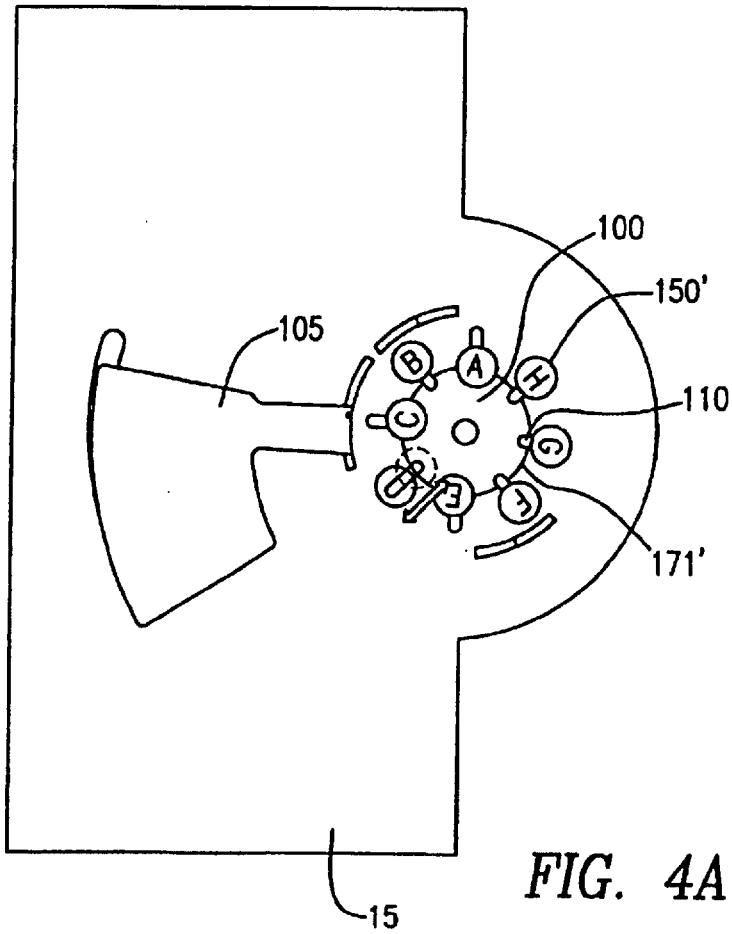
FIG. 4A is a back plan view of the primary cover of the storage device of FIG. 1 in accordance with the present invention, showing the placement of the slider components of the locking mechanism and the indicator panel.
Figure 4B:
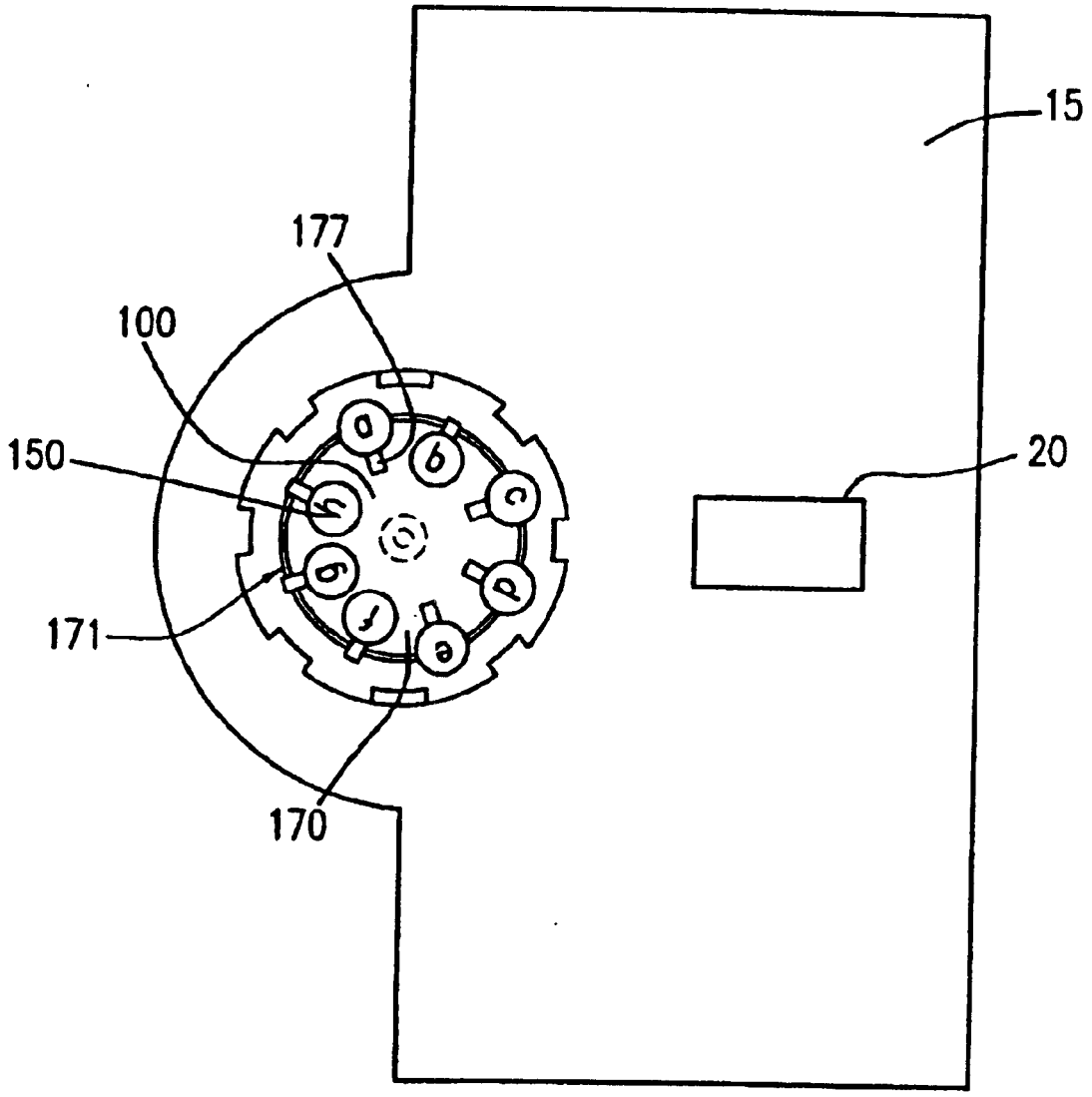
FIG. 4B is a front plan view of the primary cover of the storage device of FIG. 1 in accordance with the present invention, showing the circular knob casing with the indicator ring and the slider components of the locking mechanism.

Referring to FIG. 4A, there is shown the interior side of the primary cover 15 of a storage device of the present invention showing the placement of eight interior slider components 150' on the underside of locking mechanism 100, the interior selection ring 171' and the indicator panel 105. In FIG. 4B, interior sliders H, G, F, and B are slid outwardly along slots 110 into an engaged position, while interior sliders C, D, E, and A are slid inwardly along slots 110 into a non-engaged position.

Referring to FIG. 4B, there is shown the exterior side of the primary cover 15 of a storage device of the present invention showing the placement of the circular knob casing 170 with the indicator ring 171 and the eight exterior slider components 150 of locking mechanism 100. In FIG. 4B, exterior sliders c, d, e, and a are slid outwardly along slots 177 into an engaged position, while sliders b, f, g, and h are slid inwardly along slots 177 into a non-engaged position.

Figure 5A:
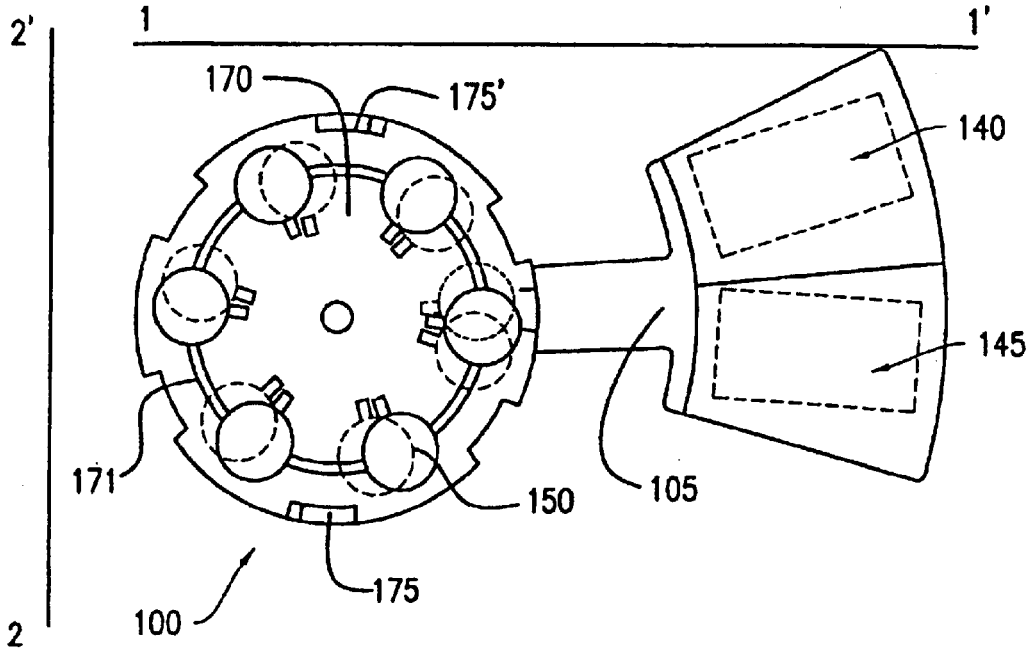
FIG. 5A is a the top view of an embodiment of a combination disc component of a locking mechanism with the locking mechanism indicator panel attached and the sliders in place in accordance with the present invention.

Referring to FIG. 5A, there is shown a top plan view of a circular knob casing 170 of a locking mechanism 100 of the present invention with the locking mechanism indicator panel 105 attached thereto and six exterior sliders 150 in place around the indicator ring 171 and six interior sliders 150' shown in phantom. The indicator panel 105 shows in phantom the area of application by paint or decal or other manner known to those skilled in the art of designations unlocked/unsecured/enter 140 and locked/secured/do not enter 145.

Figure 5B:
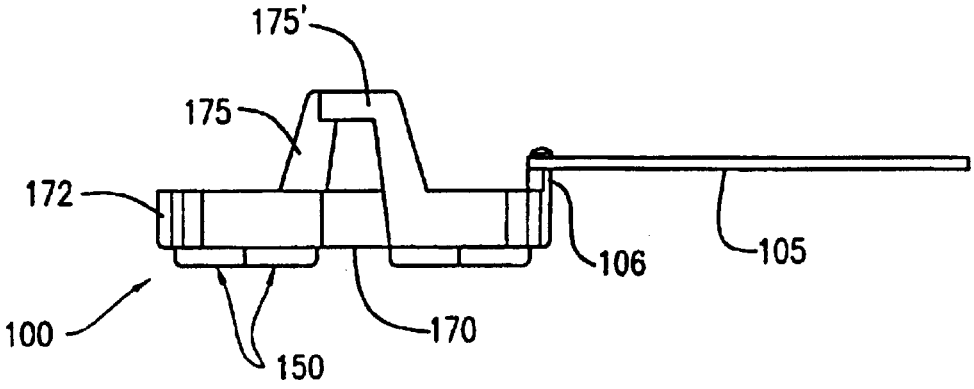
FIG. 5B is a side view of FIG. 5A along line 1 to 1' showing the locking mechanism elongated hook shaped arms in accordance with the present invention.

Referring to FIG. 5B there is shown a side plan view of FIG. 5A along line 1 to 1' showing a locking mechanism 100 of the present invention with the circular knob casing 170, the side of the circular knob casing 172 which forms a skirt around the perimeter of the under side of the circular knob casing 170, exterior sliders 150, elongated hook shaped arms 175 and 175', locking mechanism indicator panel 105, and molded protrusion 106 which is the point at which the locking mechanism indicator panel 105 is mounted to the circular knob casing 170.

Figure 5C:
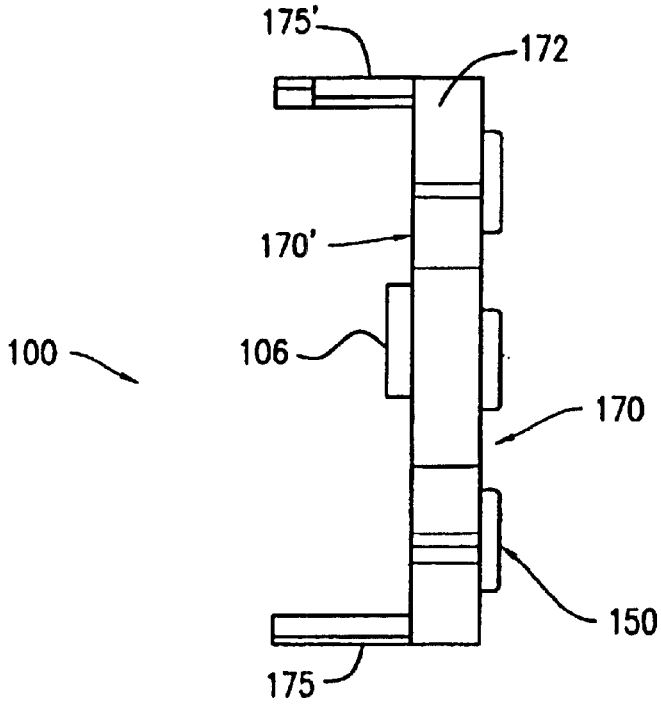
FIG. 5C is a side view of FIG. 5A along line 2 to 2' showing the locking mechanisms elongated hook shaped arms in accordance with the present invention.

Referring to FIG. 5C there is shown a side plan view of FIG. 5A along line 2 to 2' showing the locking mechanism 100 with the circular knob casing 170, side of the circular knob casing 172, which forms a skirt around the perimeter of the under side of the circular knob casing 170', exterior sliders 150, elongated hook shaped arms 175 and 175' and molded protrusion 106 which is the point at which the locking mechanism indicator panel 105 (not shown) is mounted to the circular knob casing 170.

Figure 5D:
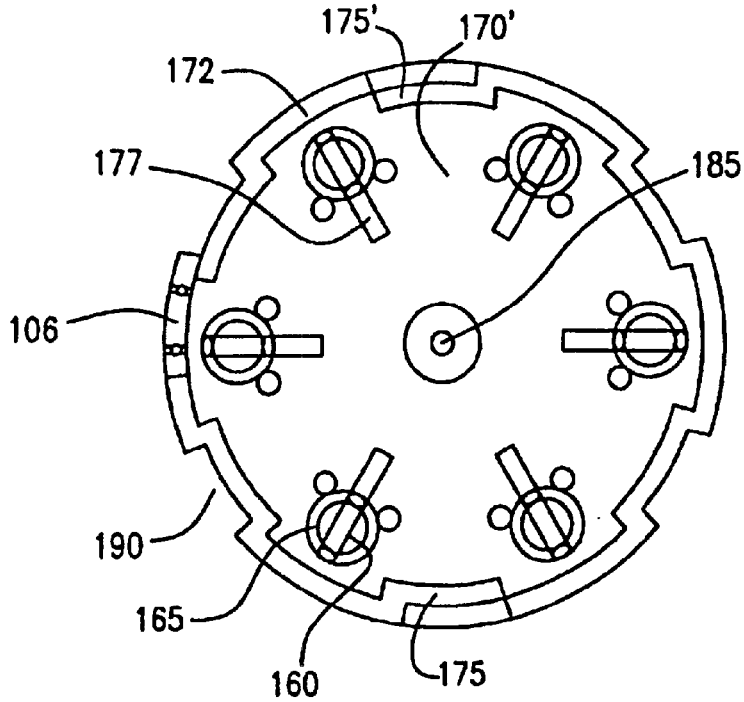
FIG. 5D is the bottom view FIG. 5A without the locking mechanism indicator panel attached in accordance with the present invention.

Referring to FIG. 5D is a bottom plan view of FIG. 5A showing the showing the bottom of the circular knob casing 170' and the side of the circular knob casing 172, which forms a skirt around the perimeter of the under side of the circular knob casing 170'. Also shown are the locking tabs 160 of the exterior sliders (not shown) that are shown protruding down through the die cut or molded slots 110 in the circular knob bottom side casing 170'. The slots 110 are arranged in a circular plane around a center die cut or molded axis 185 in the circular knob bottom side casing 170'. Washers 165 secure locking tabs 160 to the interior side of the casing 170'. Also depicted are the elongated hook shaped arms 175 and 175' and the molded protrusion 106 which is the point at which the locking mechanism indicator panel 105 (not shown) is mounted to the circular knob casing 170. There are also shown molded indentations 190 around the outside skirt 172 of the casing which aid in gripping the circular knob casing an therefore aid in turning the circular knob casing.

Figure 6A:
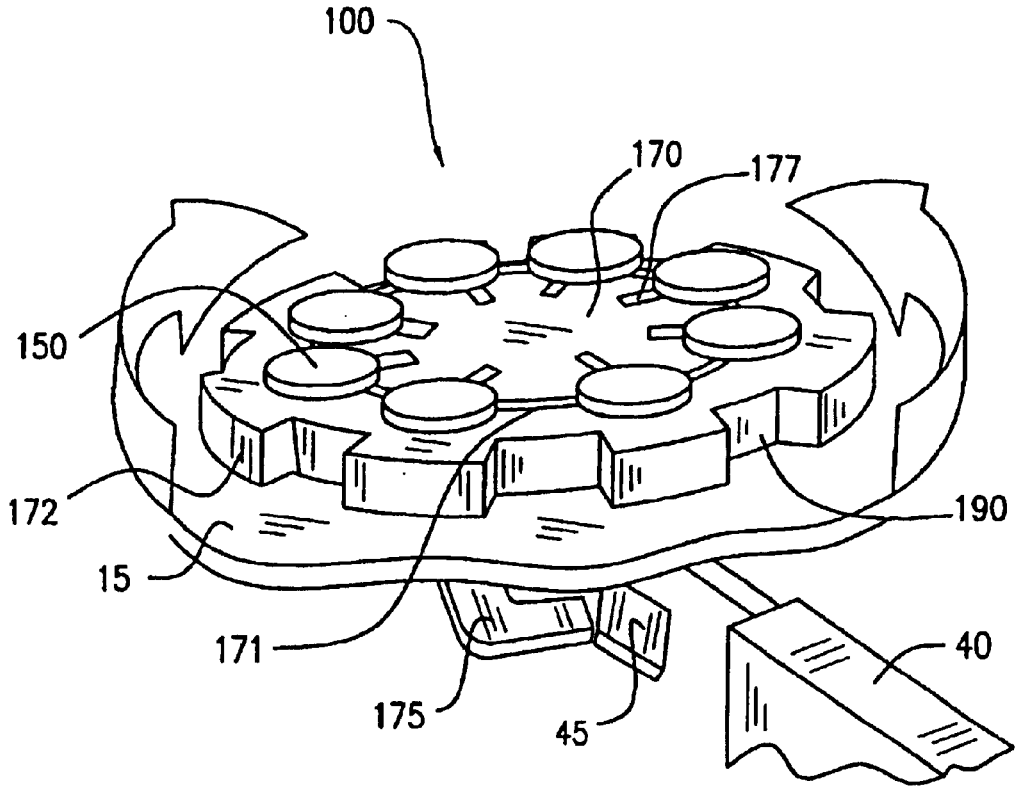
FIG. 6A is a perspective view of FIG. 5A showing the locking mechanism elongated hook shaped arms and the rigid partition to which the locking mechanism will attach in accordance with the present invention.

Referring to FIG. 6A, there is shown a front perspective view of a locking mechanism 100 of the present invention that is comprised of a circular knob casing 170, mounted on the primary cover 15 and containing die cuts or molded slots 177 in which the exterior sliders 150 are secured in place by washers (not shown). The side of the circular knob casing 172 has die cuts or molded indentations 190 that aid in gripping the circular knob casing 170 and therefore aid in turning the circular knob casing to from the locked to the unlocked position, and vice versa, when the sliders are correctly positioned in the programmed combination. The elongated hook shaped arm 175 is shown in position adjacent to the wall 40 of the lockable storage area 50 (see FIG. 3B) containing a die cut or molded hole 45 suitable for accepting the hook shaped protrusion 175 and thereby securing the primary cover 15 to the container 5 (not shown) or the primary cover 15 and the secondary cover 10 (not shown) to the container 5 (not shown). Similarly, hook shaped protrusion 175' (not shown) will fit into a corresponding die cut or molded hole 45' (see FIG. 3B) in the opposite direction on the other side of the locking mechanism 100.

Figures 6B, 6C, 6D:
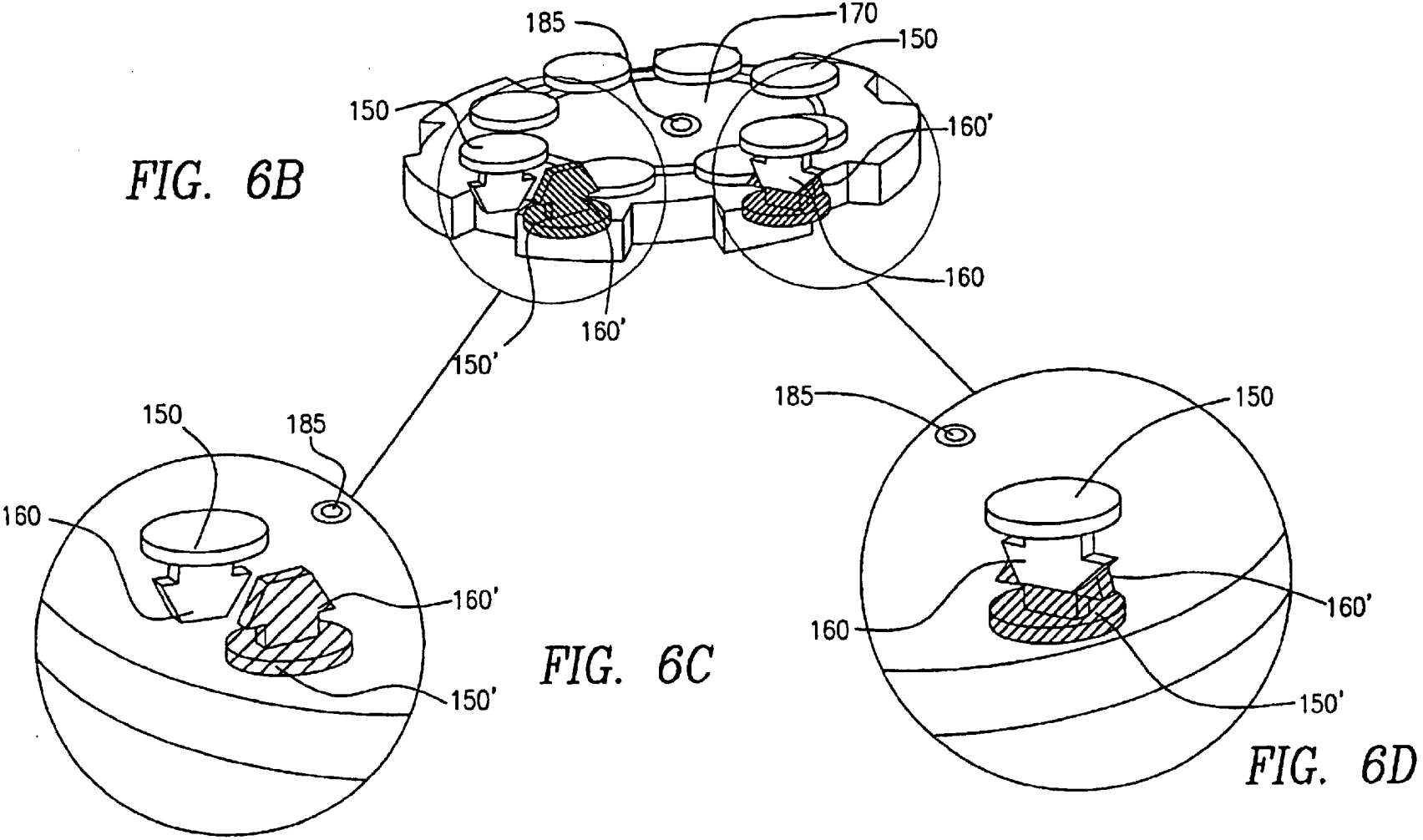
FIG. 6B is a phantom view of FIG. 6A.
FIG. 6C is an enlarged view of preferred slider components of the locking mechanism of FIG. 6B of the present invention in the unlocked position.
FIG. 6D is an enlarged view of preferred slider components of the locking mechanism of FIG. 6B of the present invention in the locked position.

Referring to FIG. 6B, there is shown a phantom view of a section of FIG. 6A containing the circular knob casing 170 with the exterior sliders 150 in relation to the interior sliders 150' around center 185 in both the unlocked (FIG. 6C) and the locked (FIG. 6D) positions.

Referring to FIG. 6C, there is shown an enlarged view of slider components 150 and 150' of a locking mechanism 100 of the present invention in the unlocked position. Exterior slider 150 is positioned on the outer portion of its slot 177 (not shown) and interior slider 150' is positioned along its slot 110 (not shown) at a point closest to the center 185. With the above described positioning, upon rotation of the circular casing 170, locking tab 160 of exterior slider 150 will rotate past locking tab 160' of interior slider 150' freely.

Referring to FIG. 6D, there is shown an enlarged view of slider components 150 and 150' of a locking mechanism 100 of the present invention in the locked position. Exterior slider 150 is positioned on the inner portion of its slot 177 (not shown) and the interior slider 150' is position along its slot 110 (not shown) at a point closest to the center 185. With the above described positioning, upon rotation of the circular casing 170, the locking tab 160 of exterior slider 150 will encounter the locking tab 160' of interior slider 150' and prevent the rotation of the circular casing.

Figure 7:
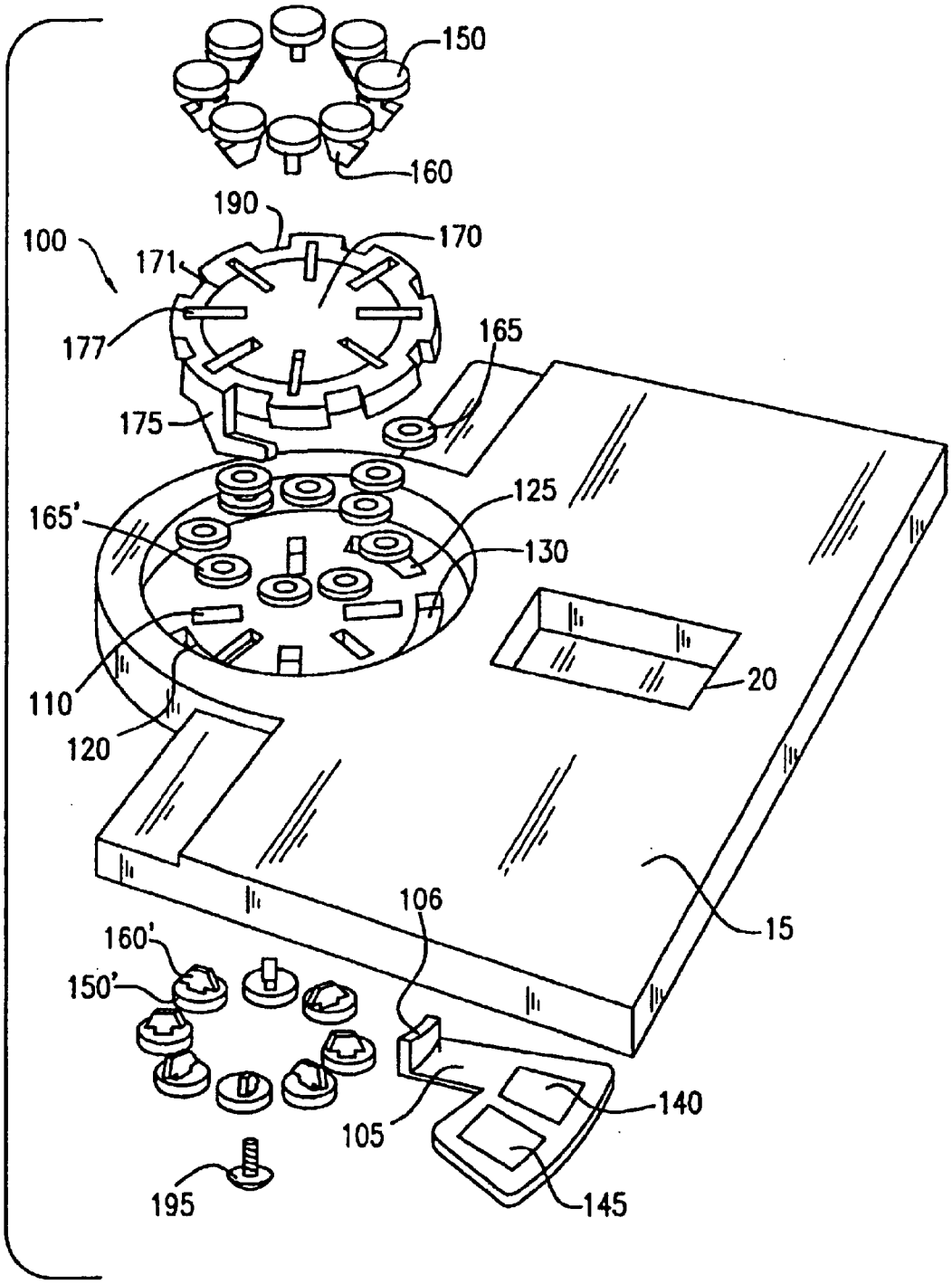
FIG. 7 is an exploded view of the locking mechanism and its placement on the primary cover in accordance with the present invention.
Figures 6B, 6C, 6D:
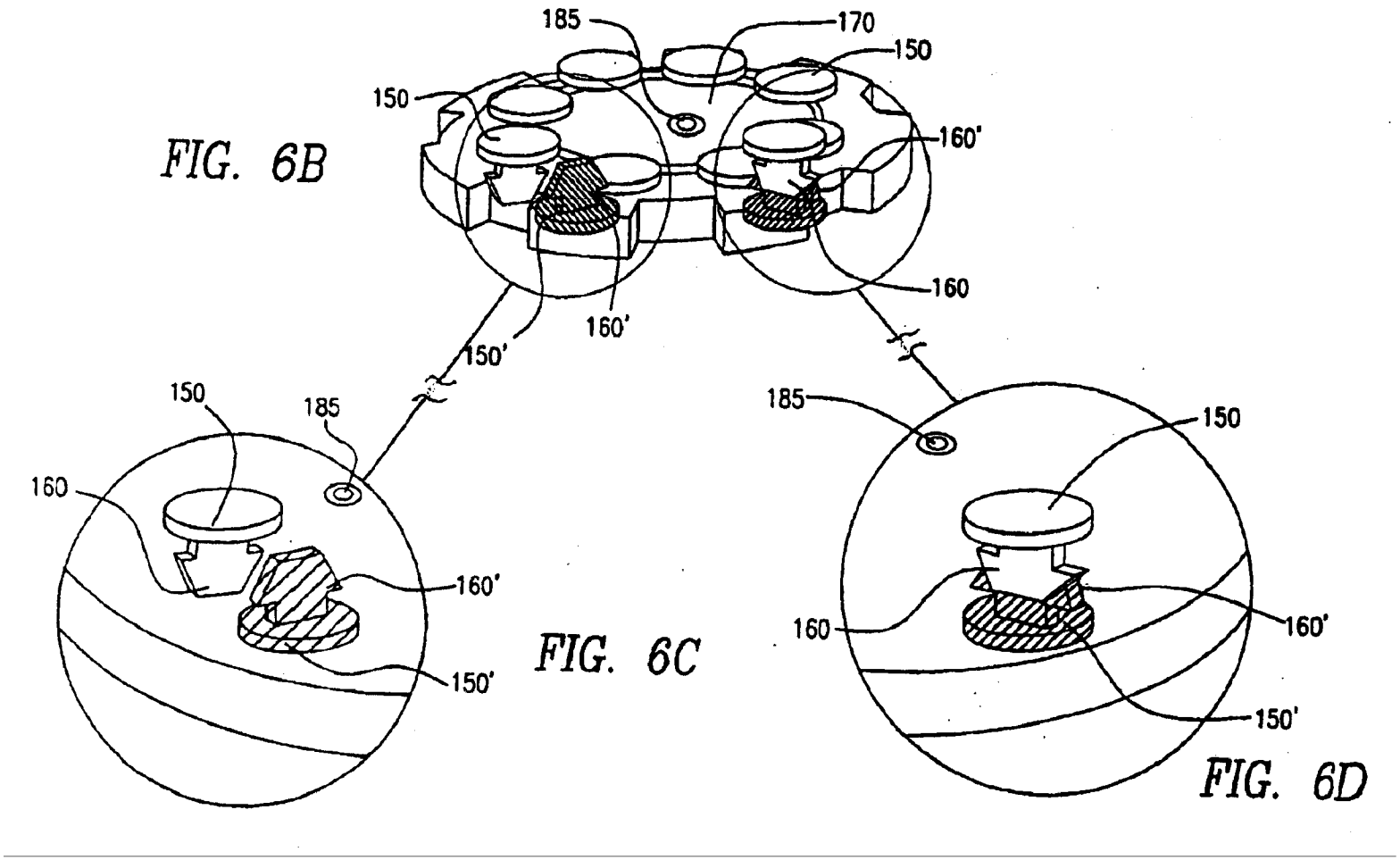

Referring to FIG. 7, there is shown an exploded view of a locking mechanism 100 of the present invention and its placement on the primary cover 15. Starting from the top of FIG. 7, the exterior sliders 150 are depicted in position over the slots 177 which are die cut or molded in the circular knob casing 170, the locking tabs 160 of the exterior sliders 150 will be inserted through the slots 177 in the circular knob casing 170 and secured to the casing 170 with washers 165 sufficient to secure the sliders 150 to the casing while allowing the sliders to slidably move along their respective slots 177. Next depicted in FIG. 7 are the washers 165' that will secure the locking tabs 160' of the interior sliders 150' when the sliders are inserted through the slots 110 in the primary cover 15, the washers 165 are fastened to sufficiently secure the sliders 150' to the primary cover 15 while allowing the sliders to slidably move along their respective slots 110. After the exterior sliders 150 and the interior sliders 150' are secured to the circular knob casing 170 and the primary cover 15, respectively, the circular knob casing can be attached to the primary cover 15 by inserting the elongated hook shaped arms 175 (shown) and 175' (not shown) of the circular knob casing 170 through the die cut or molded slots 120 and 125, respectively, and positioning the locking tabs 160 of the exterior sliders 150 adjacent to locking tabs 160' of the interior sliders 150'. Next the indicator panel 105 is inserted from the interior side of the primary cover 15 through slot 130 and secured to the circular knob casing 170 at position 106 positioned with the designations unlocked/unsecured/enter 140 and locked/secured/do not enter 145 on the top. Finally, the circular knob casing is secured to the primary cover 15 with a screw 195 or other suitable means which will allow for the rotation of the circular knob casing 170.

The exterior sliders 150 and interior sliders 150' have been individually identified, however it is possible to utilize the device without individual designations, merely relying on the position of the sliders, or one may designate the individual sliders with any alpha, numeric, symbolic or graphic designations. The only caveat being that the designations of each of the exterior sliders 150 must have a corresponding designation to each adjacent interior slider 150'.

To facilitate explanation of the programming and operation of the locking mechanism, each slider shall be specifically designated. Beginning with the exterior sliders, with the locking mechanism in the unlocked position, the slider at the 12 o'clock position is designated "a" and continuing in a clockwise direction, the next slider is "b", then "c", "d", "e", "f", "g" and "h". Next, the interior sliders 150', beginning at the 12 o'clock position and proceeding clockwise, the first slider is designated "A", the next slider is designated "H" and then "G", "F", "E", "D", "C" and "B".

To program the combination into the locking device, primary lid 15 is opened and the interior sliders 150' are positioned either inside the intersecting the interior selection ring 171', or outside the interior selection ring 171'. Next, close the primary cover 15 and position the exterior sliders 150 to the corresponding position of the interior sliders 150', i.e. if "A" is inside the interior selection ring 171' then "a" must be inside the exterior selection ring 171. Then close the primary cover and rotate the circular knob casing counterclock wise to secure the cover, noting the designation at the display window 20 has changed from unlocked/unsecured/enter 140 to locked/secured/do not enter 145. Finally, the exterior sliders 150 are rearranged, to scramble the new combination.

To unlock the locking device 100 and gain access to the secure compartment 50, position each of the exterior sliders that are part of the set combination inside the exterior selection ring 171 and all the remaining exterior sliders 150 outside the selection ring 171. Then rotate the circular knob casing 170 clockwise until the designation at the display window 20 has changed from locked/secured/do not enter 145 to unlocked/unsecured/enter 140, and open the primary cover 15.

One preferred embodiment of the present invention is a spy game that comprises an instruction manual in book form 25 that is mounted on the secondary cover 10 and is accessible to the user when the container 5 is locked or unlocked. The instruction manual provides information and/or clues in the form of math questions, rebuses, riddles and puzzles that allow the game participant the opportunity to discover the combination to the locking mechanism 100 and open the primary cover 15 thereby releasing the secondary cover 10 and allowing entry to the secure storage areas 50 and 51 and any manipulatives 55 stored in same. The puzzles and the like set forth in book 25 are preferably in the context of a spy story in which solving the puzzles also solves the spy mystery. The manipulatives 55 may include game pieces, instruction manuals, including instructions on how to reprogram the combination of the locking mechanism 100. Other objects that may be placed in the secured compartments 50 and 51 include, but are not limited to, identification cards, a mirror, a flashlight, a compass, magnets, code book, and mission instructions. Preferably, the other objects or components or manipulatives support the theme of the book or allow for greater interaction with the book. Additionally, the other objects can provide for extensions of the theme of the book, or activities related to the book theme.

While the preferred embodiment of the present invention is a spy game which comprises an instruction manual in book form 25 which provides information and/or clues which allow the game participant with the opportunity to discover the combination to the locking mechanism 100 and gain entry to the secured storage areas 50 and 51, the invention lends itself to various games or activities in which the accessible book provides materials in the form of games and/or puzzles or the like which provide clues to discerning the combination to open the locked portion of the storage device or any application where there is a combination of non-confidential or coded information and the storage of confidential information.

Another embodiment of the present invention is the Junior Magician's Book of Magic and Secret Trunk, which comprises an instruction manual in book form 25 that provides information and/or clues in the form of math questions, rebuses, riddles, puzzles and science experiments that allow the participant the opportunity to discover the combination to the locking mechanism 100 and open the primary cover 15 thereby releasing the secondary cover 10 and allowing entry to the secure storage areas 50 and 51 and any manipulatives 55 stored in same. The manipulatives 55 may include diagrams, illustrations and instructions on performing magic tricks, and props, namely, coins, cards, interlocking rings and a magic wand.

Another embodiment of the present invention is the Junior Scientist's Book of Experiments and Secret Safe, which comprises an instruction manual in book form 25 that provides information and/or clues in the form of math questions, rebuses, riddles, puzzles and science experiments that allow the participant the opportunity to discover the combination to the locking mechanism 100 and open the primary cover 15 thereby releasing the secondary cover 10 and allowing entry to the secure storage areas 50 and 51 and any manipulatives 55 stored in same. The manipulatives 55 may include diagrams, illustrations and instructions on performing experiments, and equipment, namely, test tubes, a microscope, a scale, a compass and a timer.

Various modifications to the above invention will become apparent to those skilled in the art, all of which are intended to fall within the spirit and scope of the present invention. All patents and publications referred to herein are hereby incorporated by reference.

I claim:

1. A combination book and lockable storage device comprising:

(a) a container portion equipped with a combination lock for locking said container portion; and (b) a book attached to said device in a manner such that the book is accessible to a user of the device when the container portion is locked.

2. A device as defined in claim 1 wherein said book contains clues regarding learning the combination lock for opening said container portion.

3. A device as defined in claim 1 wherein said combination lock is programmable by the user.

4. A device as defined in claim 1 wherein said book is mounted to said device.

5. A device as defined in claim 1 wherein said book comprises a means for detaching said book from said device.

6. A device as defined in claim 5 wherein said means for detachment comprises VELCRO® hook and loop fasteners, snaps or magnets.

* * * * *

UNITED STATES PATENT AND TRADEMARK OFFICE

CERTIFICATE OF CORRECTION

PATENT NO. : 6,905,140 B2
DATED : June 14, 2005
INVENTOR(S) : Peter Polick

It is certified that error appears in the above-identified patent and that said Letters Patent is hereby corrected as shown below:

Drawing sheet 12, with Figures 6B - 6D should be replaced with the corrected drawing, which shows broken lines from Figures 6B to 6C; and Figures 6B to 6D.

Signed and Sealed this

Sixth Day of September, 2005

JON W. DUDAS
*Director of the United States Patent and Trademark Office*